US011313388B1

(12) United States Patent
Pintore et al.

(10) Patent No.: US 11,313,388 B1
(45) **Date of Patent: *Apr. 26, 2022**

(54) SYSTEM AND METHOD FOR CONTROLLING HYDRAULIC FLUID FLOW WITHIN A WORK VEHICLE

(71) Applicant: CNH Industrial America LLC, New Holland, PA (US)

(72) Inventors: Francesco Pintore, Modena (IT); Stefano Fiorati, Ferrara (IT); Jason David Fox, Tucson, AZ (US); Andrea Vacca, West Lafayette, IN (US); Xin Tian, Lafayette, IN (US)

(73) Assignee: CNH Industrial America LLC, New Holland, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/162,359

(22) Filed: Jan. 29, 2021

(51) Int. Cl.

| | |
|---|---|
| ***F15B 11/16*** | (2006.01) |
| ***E02F 9/22*** | (2006.01) |
| ***F15B 13/06*** | (2006.01) |

(52) U.S. Cl.
CPC ..... *F15B 11/161* (2013.01); *E02F 9/2228* (2013.01); *E02F 9/2235* (2013.01); *E02F 9/2285* (2013.01); *E02F 9/2296* (2013.01); *F15B 11/163* (2013.01); *F15B 13/06* (2013.01); *F15B 2211/20553* (2013.01);
(Continued)

(58) Field of Classification Search
None
See application file for complete search history.

(56) References Cited

U.S. PATENT DOCUMENTS

| | | | |
|---|---|---|---|
| 3,987,622 | A | 10/1976 | Johnson |
| 4,796,661 | A | 1/1989 | Hishinuma et al. |

(Continued)

FOREIGN PATENT DOCUMENTS

| | | |
|---|---|---|
| EP | 2320094 | 5/2011 |
| EP | 3076028 | 10/2016 |

OTHER PUBLICATIONS

Massimo et al., "Energy Saving in the Hydraulic Circuit for Agricultural Tractors: Focus on the Power Supply Group", Scientific Proceedings XXIII International Scientific-Technical Conference, Dated Jun. 30, 2015 (7 pages) https://trans-motauto.com/sbornik/2015/1/08.ENERGY%20SAVING%20IN%20THE%20HYDRAULIC%20CIRCUIT%20FOR%20AGRICULTURAL%20TRACTORS%20-%20FOCUS%20ON%20THE%20POWER%20SUPPLY%20GROUP.pdf.

(Continued)

*Primary Examiner* — Michael Leslie
(74) *Attorney, Agent, or Firm* — Rickard K. DeMille; Rebecca L. Henkel

(57) ABSTRACT

A system for controlling hydraulic fluid flow within a work vehicle includes a pilot conduit fluidly configured to receive a pilot flow of the hydraulic fluid from a fluid supply conduit such that an operation of a compensator valve is controlled based on a pressure of the pilot flow. Furthermore, the system includes a pilot conduit valve configured to adjust the pressure of the pilot flow within the pilot conduit. A computing system is configured to determine the pressure of the hydraulic fluid within the fluid supply conduit downstream of the flow control valve based on the data captured by a pressure sensor. Furthermore, the computing system is configured to control an operation of the pilot conduit valve to selectively adjust the pressure of the pilot flow within the pilot conduit based on the determined pressure.

19 Claims, 6 Drawing Sheets

(52) U.S. Cl.
CPC ..... *F15B 2211/253* (2013.01); *F15B 2211/30535* (2013.01); *F15B 2211/40561* (2013.01); *F15B 2211/42* (2013.01); *F15B 2211/6054* (2013.01); *F15B 2211/632* (2013.01); *F15B 2211/6306* (2013.01); *F15B 2211/6355* (2013.01)

(56) References Cited

U.S. PATENT DOCUMENTS

| | | | | |
|---|---|---|---|---|
| 5,279,122 | A * | 1/1994 | Shirai | E02F 9/2235 60/452 |
| 5,579,642 | A | 12/1996 | Wilke et al. | |
| 5,907,951 | A | 6/1999 | Toyooka et al. | |
| 6,179,570 | B1 | 1/2001 | Smith | |
| 6,318,079 | B1 | 11/2001 | Barber | |
| 6,367,365 | B1 * | 4/2002 | Weickert | F15B 11/003 91/447 |
| 6,895,852 | B2 | 5/2005 | Pieper | |
| 7,275,370 | B2 * | 10/2007 | Hesse | E02F 9/2235 60/445 |
| 7,434,393 | B2 * | 10/2008 | Hesse | E02F 9/2296 60/422 |
| 7,481,051 | B2 | 1/2009 | Bergquist | |
| 7,854,115 | B2 | 12/2010 | Pack et al. | |
| 9,091,281 | B2 | 7/2015 | Quinnell et al. | |
| 9,200,646 | B2 | 12/2015 | Weickert et al. | |
| 9,429,175 | B2 | 8/2016 | Coolidge | |
| 9,506,222 | B2 | 11/2016 | Britten et al. | |
| 9,506,480 | B2 | 11/2016 | Hiraku et al. | |
| 9,759,212 | B2 | 9/2017 | Lingenfelter et al. | |
| 10,184,228 | B2 | 1/2019 | Ito et al. | |
| 10,260,531 | B2 | 4/2019 | Kondo et al. | |
| 10,323,458 | B2 | 6/2019 | Chiaramonte et al. | |
| 10,378,184 | B2 | 8/2019 | Vigholm | |
| 10,392,780 | B2 | 8/2019 | Sugano et al. | |
| 11,143,211 | B1 * | 10/2021 | Pintore | F15B 11/161 |
| 2008/0295508 | A1 | 12/2008 | Ma et al. | |
| 2010/0307606 | A1 | 12/2010 | Russell et al. | |
| 2013/0280097 | A1 | 10/2013 | Narotham | |
| 2015/0027112 | A1 | 1/2015 | Takebayashi et al. | |
| 2016/0032566 | A1 | 2/2016 | Taddia et al. | |
| 2017/0274930 | A1 | 9/2017 | Zhang et al. | |
| 2019/0177952 | A1 | 6/2019 | Ito et al. | |

OTHER PUBLICATIONS

Olpp, "Limiting the Local Pressure in Post-Compensated Valves", Bucher Hydraulics, Dated Nov. 6, 2017 (2 pages) https://www.bucherhydraulics.com/50862/NewsBlog/Overview/HDS24/blog.aspx.

"Energy Dissipating Solutions", Ross Valve brochure, Dated Sep. 5, 2019 (6 pages) http://aftinc.com/pdf/WWF-Valves-EnergyDissipating-Ross.pdf.

"Sleeve-Energy Dissipating Valve" Specifications, Henry Pratt Company, Mueller Water Products, Inc., Dated 2019 (2 pages) https://www.henrypratt.com/products/energy-dissipating-valves/sleeve/sleeve/.

* cited by examiner

SYSTEM AND METHOD FOR CONTROLLING HYDRAULIC FLUID FLOW WITHIN A WORK VEHICLE

FIELD OF THE INVENTION

The present disclosure generally relates to work vehicles and, more particularly, to systems and methods for controlling hydraulic fluid flow within a work vehicle by adjusting compensator valve pilot pressure and/or load sense pressure.

BACKGROUND OF THE INVENTION

A work vehicle, such as a wheel loader, skid steer loader, backhoe loader, compact track loader, and the like, typically includes a hydraulic system to actuate various components of the vehicle. For example, the hydraulic system may raise and lower an implement, such as a bucket, at the operator's command. As such, the hydraulic system generally includes one or more hydraulic loads (e.g., hydraulic actuators, motors, and/or the like) and a pump configured to supply hydraulic fluid to the load(s).

Additionally, the hydraulic system may include various valves and other flow control devices to control the flow of the hydraulic fluid from the pump to the load(s). In this respect, the valves and other flow control devices may cause pressure drops at certain locations within the hydraulic system. To compensate for these pressure drops, the pump is controlled such that the pump discharges the hydraulic fluid a pressure that is typically much higher than the pressure needed to operate the hydraulic load(s) based on the operator's commands. However, operating the pump in this manner increases the energy consumption of the work vehicle, thereby reducing its fuel economy.

Accordingly, an improved system and method for controlling hydraulic fluid flow within a work vehicle would be welcomed in the technology. In particular, an improved system and method for controlling hydraulic fluid flow within a work vehicle that reduces the energy consumption of the vehicle would be welcomed in the technology.

SUMMARY OF THE INVENTION

Aspects and advantages of the technology will be set forth in part in the following description, or may be obvious from the description, or may be learned through practice of the technology.

In one aspect, the present subject matter is directed to a system for controlling hydraulic fluid flow within a work vehicle. The system includes a hydraulic load, a pump configured to supply hydraulic fluid to the hydraulic load via a fluid supply conduit, and a flow control valve fluidly coupled to the fluid supply conduit upstream of the hydraulic load. Additionally, the system includes a compensator valve fluidly coupled to the fluid supply conduit upstream of the hydraulic load and a pilot conduit fluidly coupled to the fluid supply conduit downstream of the flow control valve and the compensator valve, with the pilot conduit configured to receive a pilot flow of the hydraulic fluid from the fluid supply conduit such that an operation of the compensator valve is controlled based on a pressure of the pilot flow within the pilot conduit. Furthermore, the system includes a pilot conduit valve fluidly coupled to the pilot conduit, with the pilot conduit valve configured to adjust the pressure of the pilot flow within the pilot conduit. Moreover, the system includes a pressure sensor configured to capture data indicative of a pressure of the hydraulic fluid within the fluid supply conduit downstream of the flow control valve. In addition, the system includes a computing system communicatively coupled to the pressure sensor. The computing system is, in turn, configured to determine the pressure of the hydraulic fluid within the fluid supply conduit downstream of the flow control valve based on the data captured by the pressure sensor. Furthermore, the computing system is configured to control an operation of the pilot conduit valve to selectively adjust the pressure of the pilot flow within the pilot conduit based on the determined pressure.

In another aspect, the present subject matter is directed to a method for controlling hydraulic fluid flow within a work vehicle. The work vehicle, in turn, includes a pump configured to supply hydraulic fluid to a hydraulic load via a fluid supply conduit and a flow control valve fluidly coupled to the fluid supply conduit upstream of the hydraulic load. Furthermore, the work vehicle includes a compensator valve fluidly coupled to the fluid supply conduit upstream of the hydraulic load and a pilot conduit fluidly coupled to the fluid supply conduit and the compensator valve, with the pilot conduit configured to receive a pilot flow of the hydraulic fluid from the fluid supply conduit such that an operation of the compensator valve is controlled based on a pressure of the pilot flow within the pilot conduit. The method includes determining, with a computing system, a flow rate of the hydraulic fluid within the fluid supply conduit downstream of the flow control valve based on received flow sensor data. Moreover, the method includes determining, with the computing system, a pressure of the hydraulic fluid within the fluid supply conduit downstream of the flow control valve based on received pressure sensor data. Additionally, the method includes controlling, with the computing system, an operation of a pilot conduit valve fluidly coupled to the pilot conduit in a manner that selectively adjusts the pressure of the pilot flow within the pilot conduit to adjust the operation of the compensator valve based on the determined flow rate and the determined pressure.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
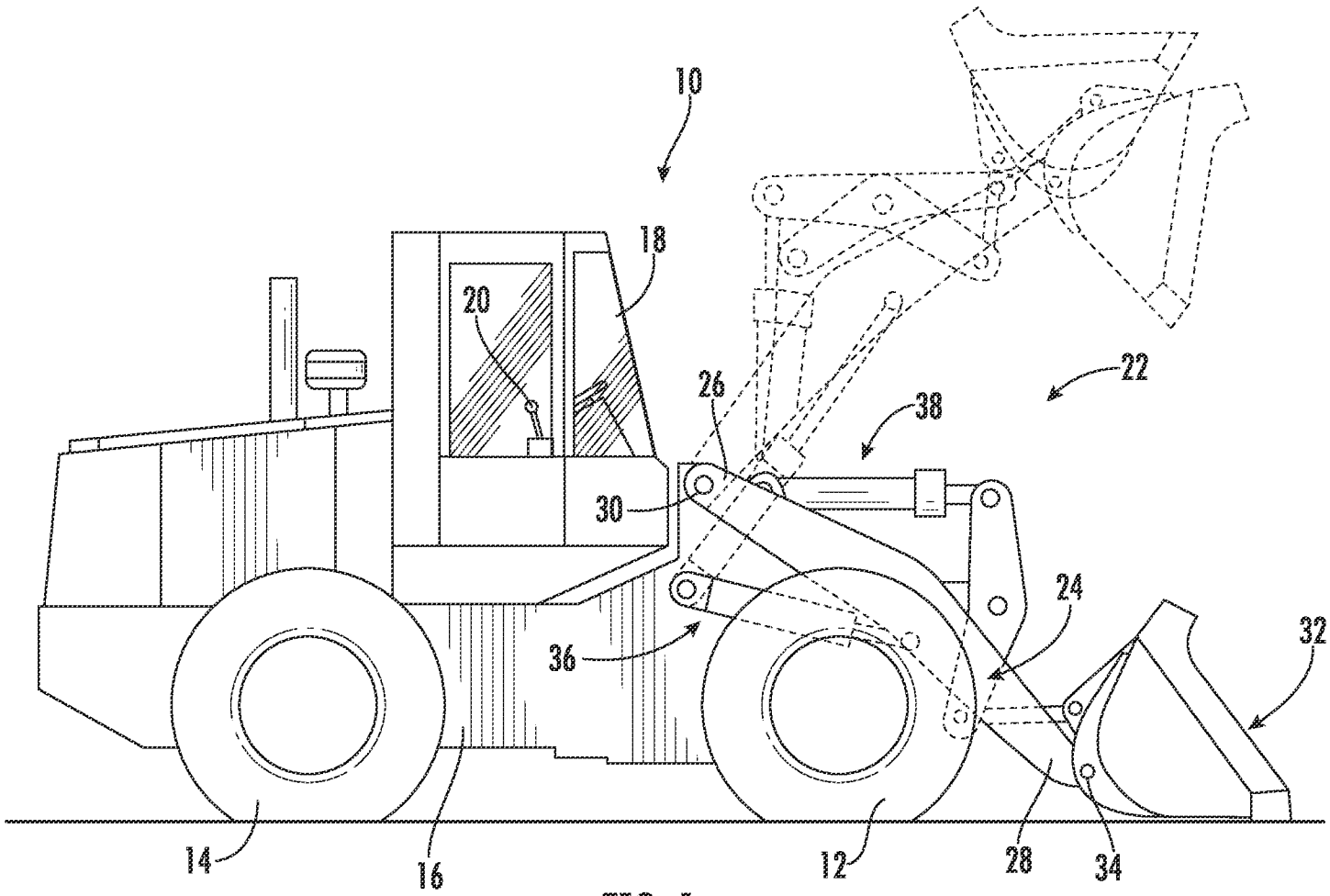
FIG. 1 illustrates a side view of one embodiment of a work vehicle in accordance with aspects of the present subject matter.

Repeat use of reference characters in the present specification and drawings is intended to represent the same or analogous features or elements of the present technology.

DETAILED DESCRIPTION OF THE DRAWINGS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to systems and methods for controlling hydraulic fluid flow within a work vehicle. As will be described below, the system may include a hydraulic load (e.g., a hydraulic actuator, motor, and/or the like) and a pump configured to supply hydraulic fluid to the hydraulic load via a fluid supply conduit. Furthermore, the system may include a flow control valve fluidly coupled to the fluid supply conduit upstream of the hydraulic load. In this respect, the flow control valve may be configured to control the flow rate of the hydraulic fluid supplied to the hydraulic load.

In several embodiments, the system may include a compensator valve fluidly coupled to the fluid supply conduit upstream of the hydraulic load. In general, the compensator valve may be configured to control the pressure drop of the hydraulic fluid across the flow control valve. Specifically, in some embodiments, the system may include a pilot conduit fluidly coupled to the fluid supply conduit downstream of the flow control valve and the compensator valve. In this respect, the pilot conduit may be configured to receive a pilot flow of the hydraulic fluid from the fluid supply conduit and supply this pilot flow to the compensator valve such that the operation of the compensator valve is controlled based on the pressure of the received pilot flow. Furthermore, in such embodiments, the system may include a pilot conduit valve fluidly coupled to the pilot conduit. As such, the pilot conduit valve may be configured to adjust the pressure of the pilot flow within the pilot conduit, thereby adjusting the operation of the compensator valve.

Moreover, in several embodiments, the system may include a load sense conduit fluidly coupled to the fluid supply conduit downstream of the flow control valve. In this respect, the load sense conduit may be configured to receive a bleed flow of the hydraulic from the fluid supply conduit and supply this bleed flow to a pump compensator. Thus, the operation of the pump may be controlled based on a pressure of the bleed flow within the load sense conduit. Specifically, in some embodiments, the system may include a load sense valve fluidly coupled to the load sense conduit. In such embodiments, the load sense valve may be configured to adjust the pressure of the bleed flow within the load sense conduit. As such, the load sense conduit valve may be configured to adjust the pressure of the bleed flow within the load sense conduit.

In accordance with aspects of the present subject matter, a computing system may be configured to control the operation of the pilot conduit valve and/or the load sense valve to the energy consumption of the work vehicle. Specifically, in several embodiments, the computing system may be configured to receive sensor data indicative of various operating parameters of the system. For example, such operating parameters may include the flow rate and/or pressure of the hydraulic fluid within the fluid supply conduit downstream of the flow control valve and/or the flow rate and/or pressure of the hydraulic fluid being discharged by the pump. Upon receipt of such sensor data, the computing device may be configured to determine the operating parameter(s) of the system. Thereafter, the computing system may be configured to control the operation of the pilot conduit valve control and/or the load sense valve to selectively adjust the pressure of the pilot flow within the pilot conduit and/or the bleed flow within the load sense conduit based on the determined operating parameters.

The disclosed system may provide one or more technical advantages. More specifically, the compensator valve may include a biasing element (e.g., a spring) that sets a compensator margin or pressure drop across the flow control valve. In certain instances, such as when a small load is placed on the hydraulic system of the work vehicle, the pressure of the pilot flow within the pilot conduit may be adjusted by the pilot conduit valve to reduce the pressure drop across the flow control valve below the pressure drop set by the biasing element. This, in turn, may reduce the energy consumption and increase the fuel economy of the work vehicle. Furthermore, the pump compensator may similarly include a biasing element (e.g., a spring) that sets a pump margin or pressure differential between the hydraulic fluid discharged by the pump and the hydraulic fluid downstream of the flow control valve. In certain instances, such as when a small load is placed on the hydraulic system of the work vehicle, the pressure of the bleed flow within the load sense conduit may be adjusted by the load sense valve to reduce the pump margin below the margin set by the biasing element. This, in turn, may reduce the energy consumption and increase the fuel economy of the work vehicle. In addition, the pilot conduit valve and the load sense valve may be controlled together to further reduce the energy consumption of the work vehicle.

Referring now to the drawings, FIG. 1 illustrates a side view of one embodiment of a work vehicle 10. As shown, the work vehicle 10 is configured as a wheel loader. However, in other embodiments, the work vehicle 10 may be configured as any other suitable work vehicle known in the art, such as any other construction vehicle (e.g., any other type of front loader, such as skid steer loaders, backhoe loaders, compact track loaders, and/or the like) or agricultural vehicle (e.g., a tractor, sprayer, harvester, and/or the like).

As shown in FIG. 1, the work vehicle 10 includes a pair of front wheels 12, a pair or rear wheels 14, and a chassis 16 coupled to and supported by the wheels 12, 14. An operator's cab 18 may be supported by a portion of the chassis 16 and may house various control or input devices (e.g., levers, pedals, control panels, buttons and/or the like) for permitting an operator to control the operation of the work vehicle 10. For instance, as shown in FIG. 1, the work vehicle 10 includes one or more control levers 20 for controlling the operation of one or more components of a lift assembly 22 of the work vehicle 10.

As shown in FIG. 1, the lift assembly 22 includes a pair of loader arms 24 (one of which is shown) extending lengthwise between a first end 26 and a second end 28. In this respect, the first ends 26 of the loader arms 24 may be pivotably coupled to the chassis 16 at pivot joints 30. Similarly, the second ends 28 of the loader arms 24 may be pivotably coupled to a suitable implement 32 of the work vehicle 10 (e.g., a bucket, fork, blade, and/or the like) at pivot joints 34. In addition, the lift assembly 22 may also include a plurality of hydraulic actuators for controlling the movement of the loader arms 24 and the implement 30. For instance, the lift assembly 22 may include a pair of hydraulic lift cylinders 36 (one of which is shown) coupled between the chassis 16 and the loader arms 24 for raising and lowering the loader arms 24 relative to the ground. Moreover, the lift assembly 22 may include a pair of hydraulic tilt cylinders 38 (one of which is shown) for tilting or pivoting the implement 32 relative to the loader arms 24.

It should be appreciated that the configuration of the work vehicle 10 described above and shown in FIG. 1 is provided only to place the present subject matter in an exemplary field of use. Thus, it should be appreciated that the present subject matter may be readily adaptable to any manner of work vehicle configuration. For example, the work vehicle 10 was described above as including a pair of lift cylinders 36 and a pair of tilt cylinders 38. However, in other embodiments, the work vehicle 10 may, instead, include any number of lift cylinders 36 and/or tilt cylinders 38, such as by only including a single lift cylinder 36 for controlling the movement of the loader arms 24 and/or a single tilt cylinder 38 for controlling the movement of the implement 32. Additionally, in some embodiments, the work vehicle 10 may include other hydraulic actuators to actuate or otherwise operate other components of the vehicle 10. Furthermore, as indicated above, in some embodiments, the work vehicle 10 may be configured as an agricultural vehicle, such as a tractor. In such embodiments, the hydraulic actuators may correspond to any suitable hydraulic actuators on the vehicle or an associated implement.

Figure 2:
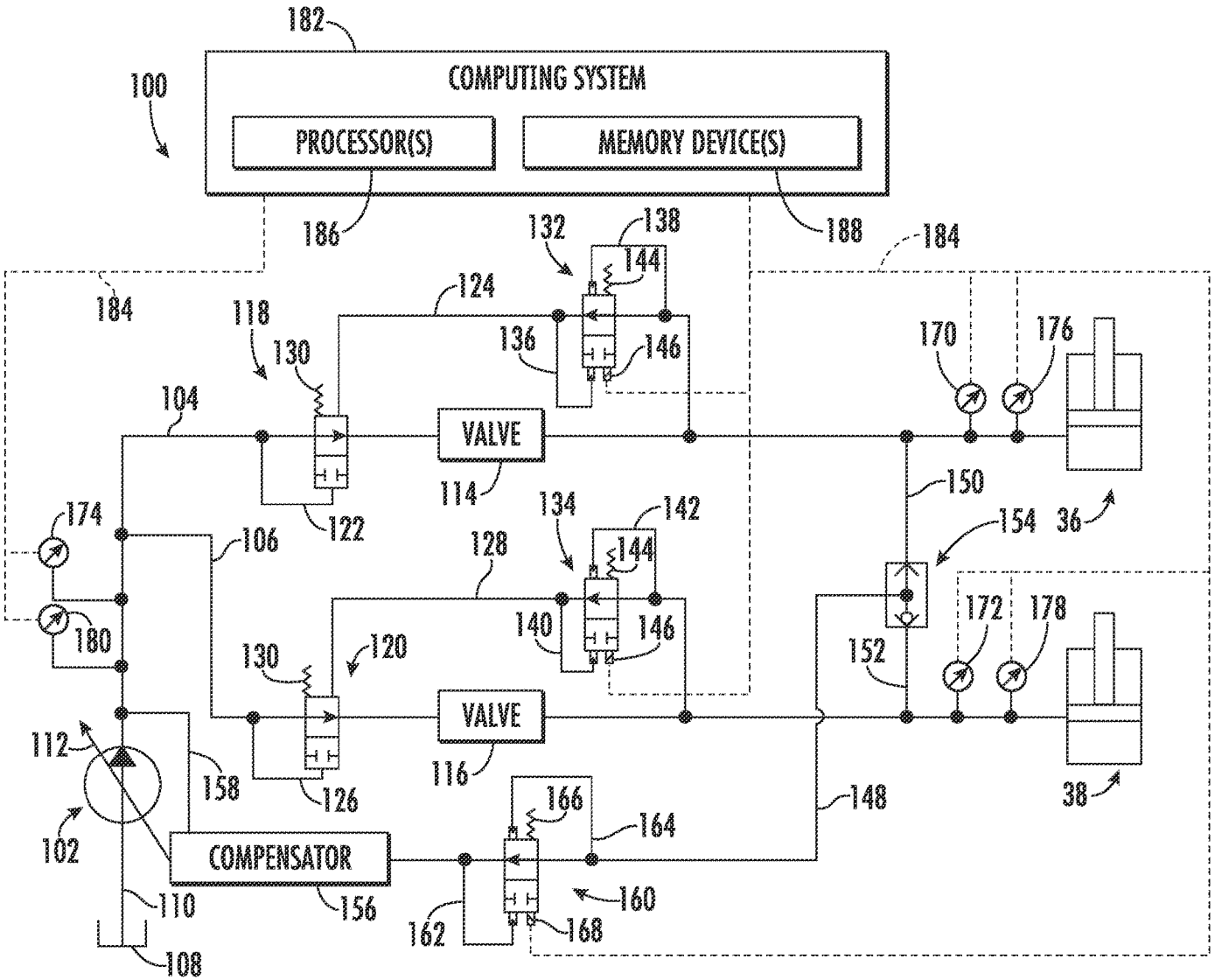
FIG. 2 illustrates a schematic view of one embodiment of a system for controlling hydraulic fluid flow within a work vehicle in accordance with aspects of the present subject matter.

Referring now to FIG. 2, a schematic view of one embodiment of a system 100 for controlling hydraulic fluid flow within a work vehicle is illustrated in accordance with aspects of the present subject matter. In general, the system 100 will be described herein with reference to the work vehicle 10 described above with reference to FIG. 1. However, it should be appreciated by those of ordinary skill in the art that the disclosed system 100 may generally be utilized with work vehicles having any other suitable vehicle configuration. For purposes of illustration, hydraulic connections between components of the system 100 are shown in solid lines while electrical connection between components of the system 100 are shown in dashed lines.

In several embodiments, as shown in FIG. 2, the system 100 may include one or more hydraulic loads of the work vehicle 10. In this respect, as will be described below, the system 100 may be configured to regulate or otherwise control the hydraulic fluid flow within the work vehicle 10 such that the hydraulic fluid is supplied to the load(s) of the vehicle 10 in a manner that reduces the energy consumption of the vehicle 10. For example, in the illustrated embodiment, the system 100 includes the lift cylinders 36 and the tilt cylinders 38 of the work vehicle 10. In such an embodiment, the lift cylinder 36 and the tilt cylinder 38 may be in parallel with each other. However, in alternative embodiments, the system 100 may include any other suitable hydraulic actuators of the work vehicle 10 in addition to or lieu of the lift and tilt cylinders 36, 38, such as hydraulic actuators associated with other implements (e.g., a backhoe assembly), stabilizer legs, and/or the like and/or hydraulic motors.

As shown in FIG. 2, the system 100 may include a pump 102 configured to supply hydraulic fluid to the hydraulic load(s) of the vehicle 10. Specifically, in several embodiments, the pump 102 may be configured to supply hydraulic fluid to the lift cylinders 36 of the vehicle 10 via a first fluid supply conduit 104 and the tilt cylinders 38 of the vehicle 10 via a second fluid supply conduit 106. However, in alternative embodiments, the pump 102 may be configured to supply hydraulic fluid to any other suitable hydraulic loads of the vehicle 10. Additionally, the pump 102 may be in fluid communication with a fluid tank or reservoir 108 via a pump conduit 110 to allow hydraulic fluid stored within the reservoir 108 to be pressurized and supplied to the lift and tilt cylinders 36, 38.

In several embodiments, the pump 102 may be a variable displacement pump configured to discharge hydraulic fluid across a given pressure range. Specifically, the pump 102 may supply pressurized hydraulic fluid within a range bounded by a minimum pressure and a maximum pressure capability of the variable displacement pump. In this respect, a swash plash plate 112 may be configured to be controlled mechanically via a load sense conduit 148 to adjust the position of the swash plate 112 of the pump 102, as necessary, based on the load applied to the hydraulic system of the vehicle 10. However, in other embodiments, the pump 102 may correspond to any other suitable pressurized fluid source. Moreover, the operation of the pump 102 may be controlled in any other suitable manner.

Furthermore, the system 100 may include one or more flow control valves. In general, the flow control valve(s) may be fluidly coupled to a fluid supply conduit(s) upstream of the corresponding hydraulic load such that the flow control valve(s) is configured to control the flow rate of the hydraulic fluid to the load (s). Specifically, in several embodiments, the system 100 may include a first flow control valve 114 fluidly coupled to the first fluid supply conduit 104 upstream of the lift cylinders 36. The first flow control valve 114 may, in turn, define an adjustable orifice (not shown). In this respect, by adjusting the cross-sectional area of the orifice, the first flow control valve 114 can control the flow rate of the hydraulic fluid to the lift cylinders 36. Moreover, in such embodiments, the system 100 may include a second flow control valve 116 fluidly coupled to the second fluid supply conduit 106 upstream of the tilt cylinders 38. The second flow control valve 116 may, in turn, define an adjustable orifice. As such, by adjusting the cross-sectional area of the orifice, the second flow control valve 116 can control the flow rate of the hydraulic fluid to the tilt cylinders 38.

The first and second flow control valves 114, 116 may be configured as any suitable valves defining adjustable orifices. For example, in one embodiment, first and second flow control valves 114, 116 may be proportional directional valves. Such valves 114, 116 may include actuators (e.g., solenoid actuators) configured to adjust the cross-sectional areas of the orifices in response to receiving control signals, such as from a computing system 182.

Additionally, the system 100 may include one or more compensator valves. Specifically, in several embodiments, the system 100 may include a first compensator valve 118 fluidly coupled to the first fluid supply conduit 104 upstream of the lift cylinders 36 and the first flow control valve 114. Moreover, in such embodiments, the system 100 may include a second compensator valve 120 fluidly coupled to the second fluid supply conduit 106 upstream of the tilt cylinders 38 and the second flow control valve 116. Thus, in such embodiments, the system 100 is a pre-compensated system.

In several embodiments, the first and second compensator valves 118, 120 may be pilot-operated valves. More specifically, a pilot conduit 122 may be fluidly coupled to the first compensator valve 118 and the first fluid supply conduit 104 upstream of the first compensator valve 118. As such, the pilot conduit 122 may provide a pilot flow of hydraulic fluid from upstream of the first compensator valve 118 to the valve 118. Furthermore, a pilot conduit 124 may be fluidly coupled to the first compensator valve 118 and the first fluid supply conduit 104 downstream of the first flow control valve 114. As such, the pilot conduit 124 may provide a pilot flow of hydraulic fluid from downstream of the first flow control valve 114 to the first compensator valve 118. Similarly, a pilot conduit 126 may be fluidly coupled to the second compensator valve 120 and the second fluid supply conduit 106 upstream of the second compensator valve 120. As such, the pilot conduit 126 may provide a pilot flow of hydraulic fluid from upstream of the second compensator valve 120 to the valve 120. Furthermore, a pilot conduit 128 may be fluidly coupled to the second compensator valve 120 and the second fluid supply conduit 106 downstream of the second flow control valve 116. As such, the pilot conduit 128 may provide a pilot flow of hydraulic fluid from downstream of the second flow control valve 116 to the second compensator valve 120. Additionally, the first and second compensator valves 118, 120 may have biasing elements 130, such as springs, that set a compensator valve margin.

In operation, the first and second compensator valves 118, 120 may be configured to regulate the pressure drop of the hydraulic fluid across the first and second control valves 114, 116, respectively. More specifically, the first compensator valve 118 may adjust the pressure within the first fluid supply conduit 104 such that the pressure of the hydraulic fluid upstream of the valve 118 is equal to the sum of the compensator margin and the pressure of the pilot flow supplied to the valve 118 by the pilot conduit 124. Similarly, the second compensator valve 120 may adjust the pressure within the second fluid supply conduit 106 such that the pressure of the hydraulic fluid upstream of the valve 120 is equal to the sum of the compensator margin and the pressure of the pilot flow supplied to the valve 120 by the pilot conduit 128. As will be described below, because the compensator margin set by the biasing elements 130 is fixed, the pressure drop across the first and second flow control valves 114, 116 can be controlled by adjusting the pressure of the pilot flows within the pilot conduits 124, 128, respectively. Such adjustment of the pressures within the pilot conduits 124, 128 may, in turn, reduce the energy consumption of the work vehicle 10.

Moreover, the system 100 may include one or more pilot conduit valves. Specifically, in several embodiments, the system 100 may include a first pilot conduit valve 132 fluidly coupled to the pilot conduit 124 (which provides the pilot flow from downstream of the first flow control valve 114 to the first compensator valve 118). Moreover, in such embodiments, a second pilot conduit valve 134 fluidly coupled to the pilot conduit 128 (which provides the pilot flow from downstream of the second flow control valve 116 to the second compensator valve 120). As will be described below, the first and second pilot conduit valves 132, 134 may be used to adjust the pressures of the pilot flows within the pilot conduits 124, 128.

In several embodiments, the first and second pilot conduit valves 132, 134 may be pilot-operated valves. More specifically, a pilot conduit 136 may be fluidly coupled to the first pilot conduit valve 132 and the pilot conduit 124 upstream of the valve 132. As such, the pilot conduit 136 may provide a pilot flow of hydraulic fluid from upstream of the first pilot conduit valve 132 to the valve 132. Furthermore, a pilot conduit 138 may be fluidly coupled to the first pilot conduit valve 132 and the pilot conduit 124 downstream of the valve 132. As such, the pilot conduit 138 may provide a pilot flow of hydraulic fluid from downstream of the first pilot conduit valve 132 to the valve 132. Similarly, a pilot conduit 140 may be fluidly coupled to the second pilot conduit valve 134 and the pilot conduit 128 upstream of the valve 134. As such, the pilot conduit 140 may provide a pilot flow of hydraulic fluid from upstream of the second pilot conduit valve 134 to the valve 134. Furthermore, a pilot conduit 142 may be fluidly coupled to the second pilot conduit valve 134 and the pilot conduit 128 downstream of the valve 134. As such, the pilot conduit 142 may provide a pilot flow of hydraulic fluid from downstream of the second pilot conduit valve 134 to the valve 134. Additionally, the first and second pilot conduit valves 132, 134 may have biasing elements 144, such as springs, that set a valve margin.

Furthermore, in some embodiments, in addition to being pilot-operated, the first and second pilot conduit valves 132, 134 may also include electric actuators 146, such as solenoids. In general, the electric actuators 146 may be electronically controlled by a computing system 182 to selectively override the pilot operation of the valves 132, 134. In this respect, when the electric actuators 146 are not activated, the first and second pilot conduit valves 132, 134 may be controlled mechanically based on the corresponding pilot flows. Specifically, in such instances, the first and second pilot conduit valves 132, 134 may adjust the pressure within the pilot conduits 124, 128 such that the pressure of the hydraulic fluid upstream of the valves 132, 134 is equal to the sum of the valve margins and the pressure of the pilot flow supplied to the valves 132, 134 by the pilot conduits 138, 142, respectively. Conversely, when the when the electric actuators 146 are activated, the electric actuators 146 may control the first and second pilot conduit valves 132, 134 to override the pilot control. In such instances, the first and second pilot conduit valves 132, 134 may adjust the pressure hydraulic fluid upstream of the valves 132, 134 (i.e., the pressure supplied to the first and second compensator valves 118, 120) based on various operating parameters of the system 100 and independently of the pressure within the pilot conduits 136, 138, 140, 142. As such, the pilot flows may be retained within the pilot conduits 124, 128 (i.e., not directed to the reservoir 108) when the pressure of these flows is adjusted by the first and second pilot conduit valves 132, 134. However, in alternative embodiments, the first and second pilot conduit valves 132, 134 may be controlled in any other suitable manner and/or by any other suitable electronically controlled actuators. For example, in one embodiment, the valves 132, 134 may not be pilot-operated and, instead, may be operated solely by the electric actuators 146 (e.g., proportional pressure-reducing valves).

Additionally, the system 100 may include a load sense conduit 148. In general, the load sense conduit 148 may receive hydraulic fluid bled from the first or second fluid supply conduit 104, 106 having the greater pressure therein. More specifically, the system 100 may include a first bleed conduit 150 fluidly coupled to the first fluid supply conduit 104 downstream of the first flow control valve 114 and the first compensator valve 118. Furthermore, the system 100 may include a second bleed conduit 152 fluidly coupled to the second fluid supply conduit 106 downstream of the second flow control valve 116 and the second compensator valve 120. Thus, the first bleed conduit 150 may receive hydraulic fluid bled from the first fluid supply conduit 104 and the second bleed conduit 152 may receive hydraulic fluid bled from the second fluid supply conduit 106. Additionally, the system 100 may include a shuttle valve 154 fluidly coupled to the first and second bleed conduits 150, 152 and the load sense conduit 148. The shuttle valve 154 may, in turn, be configured to supply hydraulic fluid from the first or second bleed conduit 150, 152 having the greater pressure therein to the load sense conduit 148. In this respect, the hydraulic fluid supplied to the load sense conduit 148 may have the same pressure as the fluid supply conduit 104, 106 having the greater pressures therein.

The hydraulic fluid within the load sense conduit 148 may be indicative of the load on the hydraulic system of the vehicle 10 and, thus, may be used to control the operation of the pump 102. More specifically, the load sense conduit 148 may supply the hydraulic fluid therein to a pump compensator 156. The pump compensator 156 may also receive hydraulic fluid bled from the first and/or second fluid supply conduits 104, 106 upstream of the flow control valves 114, 116 via a bleed conduit 158. Additionally, the pump compensator 156 may have an associated a pump margin. In this respect, the pump compensator 156 may control the operation of the pump 102 such that the pump 102 discharges hydraulic fluid at a pressure that is equal to the sum of the pump margin and the pressure of the hydraulic fluid received from the load sense conduit 148.

In this illustrated embodiment, the pump compensator 156 corresponds to a mechanical device. For instance, the pump compensator 156 may correspond to a passive hydraulic cylinder coupled to the swash plate 112 of the pump 102. In such an embodiment, hydraulic fluid from the load sense conduit 148 is supplied to one chamber of the cylinder and hydraulic fluid from a bleed conduit 158 is supplied to the other chamber of the cylinder. Moreover, the pump compensator 156 may include a biasing element, such as a spring, in association within the cylinder to set the pump margin. In this respect, when the sum of the pressure received from the load sense conduit 148 and the pump margin exceeds the pressure within the bleed conduit 158, the pump compensator 156 may move the swash plate 112 to increase the pressure of the hydraulic fluid discharged by the pump 102. Conversely, when the sum of the pressure received from the load sense conduit 148 and the pump margin falls below the pressure within the bleed conduit 158, the pump compensator 156 may move the swashplate 112 to decrease the pressure of the hydraulic fluid discharged by the pump 102. However, as will be described below, in other embodiments, the pump compensator 156 may be configured as any other suitable device for controlling the operation of the pump 102.

Additionally, the system 100 may include a load sense valve 160 fluidly coupled to the load sense conduit 148. In general, the load sense valve 160 may be configured to selectively reduce the pressure of the hydraulic fluid within the load sense conduit 148. Specifically, in several embodiments, the load sense valve 160 may be fluidly coupled to the load sense conduit 148 between the shuttle valve 154 and the pump compensator 156. In this respect, the load sense valve 160 may be configured to selectively reduce the pressure of the hydraulic fluid supplied to the pump compensator 156 by the load sense conduit 148 to a pressure that is less than the pressure of the hydraulic fluid supplied to the load sense conduit 148 by the shuttle valve 154. As will be described below, by reducing the pressure of the hydraulic fluid supplied to the pump compensator 154, the energy consumption of the vehicle 10 may be decreased.

In several embodiments, the load sense valve 160 may be a pilot-operated valve. More specifically, a pilot conduit 162 may be fluidly coupled to the load sense valve 160 and the load sense conduit 148 upstream of the valve 160. As such, the pilot conduit 162 may provide a pilot flow of hydraulic fluid from upstream of the load sense valve 160 to the valve 160. Furthermore, a pilot conduit 164 may be fluidly coupled to the load sense valve 160 and the load sense conduit 148 downstream of the valve 160. As such, the pilot conduit 164 may provide a pilot flow of hydraulic fluid from downstream of the load sense valve 160 to the valve 160. Additionally, the load sense valve 160 may have a biasing element 166, such as a spring, that sets a valve margin.

Furthermore, in some embodiments, in addition to being pilot-operated, the load sense valve 160 may also include an electric actuator 168, such as a solenoid. In general, the electric actuator 168 may be electronically controlled by a computing system 182 to selectively override the pilot operation of the load sense valve 160. In this respect, when the electric actuator 168 is not activated, the load sense valve 160 may be controlled hydraulically based on the received pilot flows. Specifically, in such instances, the load sense valve 160 may adjust the pressure within the load sense conduit 148 such that the pressure of the hydraulic fluid downstream of the valve 160 is equal to the valve margin subtracted from the pressure of the pilot flow supplied to the valve 160 by the pilot conduit 164. Conversely, when the when the electric actuator 168 is activated, the electric actuator 168 may control the load sense valve 160 to override the pilot control. In such instances, the load sense valve 160 may adjust bleed flow supplied to the pump compensator 156 by the load sense conduit 148 based on various operating parameters of the system 100 and independently of the pressure within the pilot conduits 162, 164. As such, the bleed flow may be retained within the load sense conduit 148 (i.e., not directed to the reservoir 108) when the pressure of this flow is adjusted by the load sense valve 160. However, in alternative embodiments, the load sense valve 160 may be controlled in any other suitable manner and/or by any other suitable electronically controlled actuators. For example, in one embodiment, the load sense valve 160 may not be pilot-operated and, instead, may be operated solely by the electric actuators 146 (e.g., a proportional pressure-reducing valve).

In several embodiments, the system 100 may include one or more flow sensors. In generally, the flow sensor(s) may be configured to capture data indicative of the flow rate of the hydraulic fluid at differing locations within the hydraulic system of the vehicle 10. Specifically, in one embodiment, a first flow sensor 170 may be fluidly coupled to the first fluid supply conduit 104 downstream of the first flow control valve 114 and the first compensator valve 118. As such, the first flow sensor 170 may be configured to capture data indicative of the flow rate of the hydraulic fluid at such location within the first fluid supply conduit 104. Furthermore, a second flow sensor 172 may be fluidly coupled to the second fluid supply conduit 106 downstream of the second flow control valve 116 and the second compensator valve 120. As such, the second flow sensor 172 may be configured to capture data indicative of the flow rate of the hydraulic fluid at such location within the second fluid supply conduit 106. Additionally, a third flow sensor 174 may be fluidly coupled to the first and/or second fluid supply conduits 104, 106 upstream of the flow control valves 114, 116. As such, the third flow sensor 174 may be configured to capture data indicative of the flow rate of the hydraulic fluid being discharged by the pump 102.

The flow sensors may correspond to any suitable devices for capturing data indicative of or can be used in conjunction with pressure data (described) below to estimate/determine the flow rates of the hydraulic fluid at the corresponding locations. For example, in the illustrated embodiment, the flow sensors 170, 172, 174 may correspond to flow meters that detect the flow rates of the hydraulic fluid at the corresponding locations. In another embodiments, the system 100 may include a single flow sensor, with the flow sensor configured to detect the rotation speed of the impeller of the pump 102. For example, in such an embodiment, the flow sensor may be a Hall Effect sensor provided in operative association with the pump shaft. The pump speed data may in combination with the pressure of the hydraulic fluid at various locations within the system 100 may allow the computing system 182 to determine or estimate the flow rate of the hydraulic fluid at such locations. In a further embodiment, the system 100 may include a single flow sensor, with the flow sensor configured to the position of the swash plate 112. For example, in such an embodiment, the flow sensor may be a potentiometer provided in operative association with the swash plate 112. The swash plate position data may in combination with the pressure of the hydraulic fluid at various locations within the system 100 may allow the computing system 182 to determine or estimate the flow rate of the hydraulic fluid at such locations.

Moreover, in several embodiments, the system 100 may include one or more pressure sensors. In generally, the pressure sensor(s) may be configured to capture data indicative of the pressure of the hydraulic fluid at differing locations within the hydraulic system of the vehicle 10. Specifically, in one embodiment, a first pressure sensor 176 may be fluidly coupled to the first fluid supply conduit 104 downstream of the first flow control valve 114 and the first compensator valve 118. As such, the first pressure sensor 176 may be configured to capture data indicative of the pressure of the hydraulic fluid at such location within the first fluid supply conduit 104. Furthermore, a second pressure sensor 178 may be fluidly coupled to the second fluid supply conduit 106 downstream of the second flow control valve 116 and the second compensator valve 120. As such, the second pressure sensor 178 may be configured to capture data indicative of the pressure of the hydraulic fluid at such location within the second fluid supply conduit 106. Additionally, a third pressure sensor 180 may be fluidly coupled to the first and/or second fluid supply conduits 104, 106 upstream of the flow control valves 114, 116. As such, the third pressure sensor 180 may be configured to capture data indicative of the pressure of the hydraulic fluid being discharged by the pump 102.

In accordance with aspects of the present subject matter, the system 100 may include a computing system 182 communicatively coupled to one or more components of the work vehicle 10 and/or the system 100 to allow the operation of such components to be electronically or automatically controlled by the computing system 182. For instance, the computing system 182 may be communicatively coupled to the first and second pilot conduit valves 132, 134 via a communicative link 184. As such, the computing system 182 may be configured to control the operation of the first and second pilot conduit valves 132, 134 to regulate the pressure drops across the first and second flow control valves 114, 116, respectively, such that the energy consumption of the vehicle 10 is reduced. Furthermore, the computing system 182 may be communicatively coupled to the load sense valve 160 via the communicative link 184. In this respect, the computing system 182 may be configured to control the operation of the load sense valve 160 to adjust the pressure of the hydraulic fluid supplied to the pump compensator 156 by the load sense conduit 148. As will be described below, such adjustment to the pressure of the hydraulic fluid supplied to the pump compensator 156 may reduce the energy consumption of the vehicle 10. Moreover, the computing system 182 may be communicatively coupled to the flow sensors 170, 172, 174 and the pressure sensors 176, 178, 180 via the communicative link 184. Thus, the computing system 182 may be configured to receive data from these sensors 170, 172, 174 176, 178, 180 that is indicative of the flow rates and pressures of the hydraulic fluid at the corresponding locations within the system 100.

In general, the computing system 182 may comprise one or more processor-based devices, such as a given controller or computing device or any suitable combination of controllers or computing devices. Thus, in several embodiments, the computing system 182 may include one or more processor(s) 186 and associated memory device(s) 188 configured to perform a variety of computer-implemented functions. As used herein, the term "processor" refers not only to integrated circuits referred to in the art as being included in a computer, but also refers to a controller, a microcontroller, a microcomputer, a programmable logic circuit (PLC), an application specific integrated circuit, and other programmable circuits. Additionally, the memory device(s) 188 of the computing system 182 may generally comprise memory element(s) including, but not limited to, a computer readable medium (e.g., random access memory RAM)), a computer readable non-volatile medium (e.g., a flash memory), a floppy disk, a compact disk-read only memory (CD-ROM), a magneto-optical disk (MOD), a digital versatile disk (DVD) and/or other suitable memory elements. Such memory device(s) 188 may generally be configured to store suitable computer-readable instructions that, when implemented by the processor(s) 186, configure the computing system 182 to perform various computer-implemented functions, such as one or more aspects of the methods and algorithms that will be described herein. In addition, the computing system 182 may also include various other suitable components, such as a communications circuit or module, one or more input/output channels, a data/control bus and/or the like.

The various functions of the computing system 182 may be performed by a single processor-based device or may be distributed across any number of processor-based devices, in which instance such devices may be considered to form part of the computing system 182. For instance, the functions of the computing system 182 may be distributed across multiple application-specific controllers or computing devices, such as an implement controller, a navigation controller, an engine controller, and/or the like.

Figure 3:
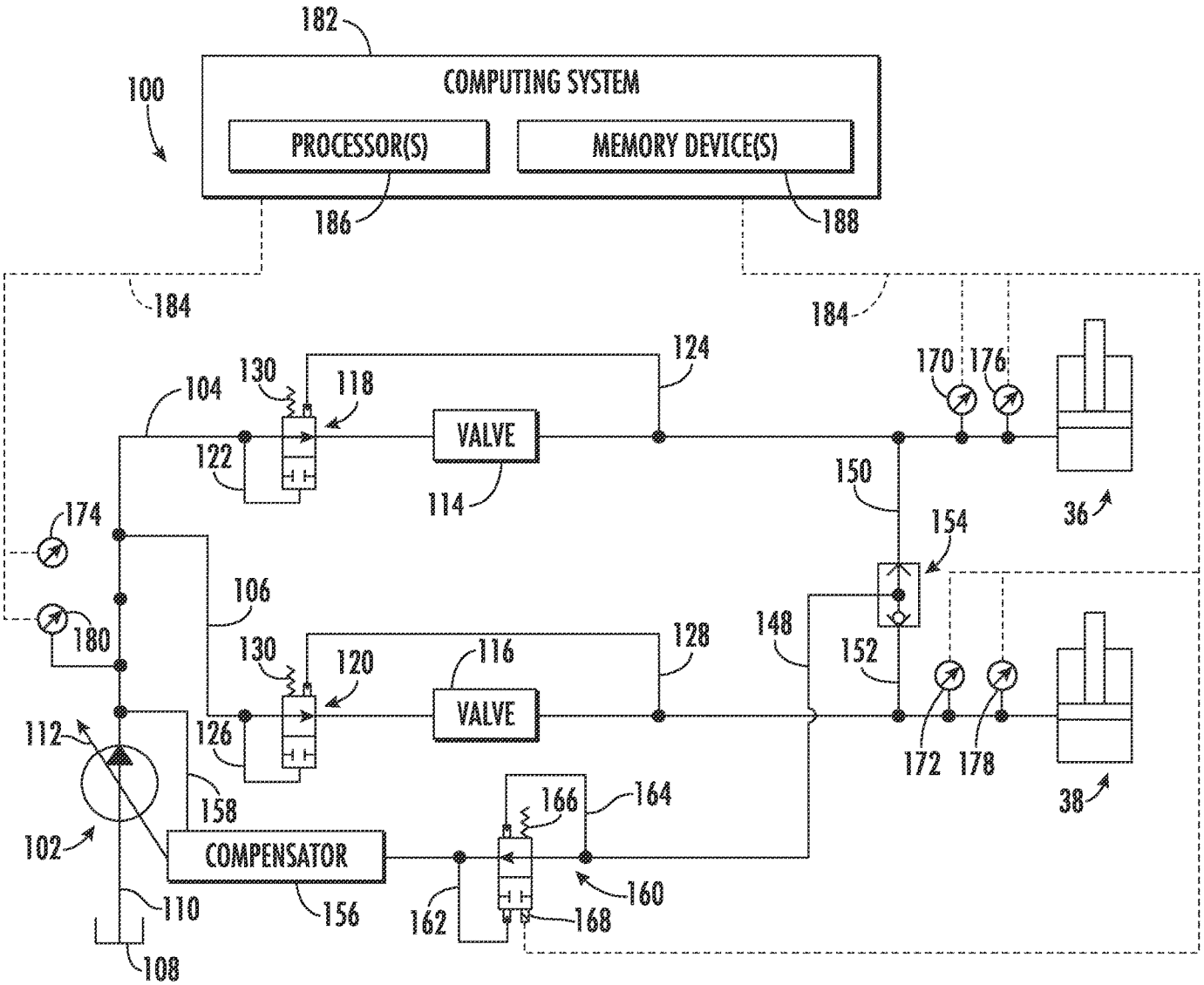
FIG. 3 illustrates a schematic view of another embodiment of a system for controlling hydraulic fluid flow within a work vehicle in accordance with aspects of the present subject matter.

Referring now to FIG. 3, a schematic view of another embodiment of a system 100 for controlling hydraulic fluid flow within a work vehicle is illustrated in accordance with aspects of the present subject matter. In general, the embodiment of the system 100 depicted in FIG. 3 is configured similarly to the embodiment of the system 100 depicted in FIG. 2. For example, like the system 100 illustrated in FIG. 2, the system 100 shown in FIG. 3 includes various components of the hydraulic system of the work vehicle 10, such as the lift cylinders 36; the tilt cylinders 38; the pump 102; the fluid supply conduits 104, 106; the flow control valves 114, 116; the compensator valves 118, 120; the associated pilot conduits 122, 124, 126, 128; the load sense conduit 148; the bleed conduits 150, 152; the shuttle valve 154; the pump compensator 156; and the load sense valve 160 as well as the controller 182 and the sensors 170, 172, 174, 176, 178, 180. However, unlike the system 100 of FIG. 2, the system 100 depicted in FIG. 3 does not include the pilot valves 132, 134. As such, unlike the system 100 of FIG. 2, in the system 100 illustrated in FIG. 3, the computing system 182 may only be able to improve the efficiency of the work vehicle 10 by controlling the operation of the load sense valve 160 as described above.

Figure 4:
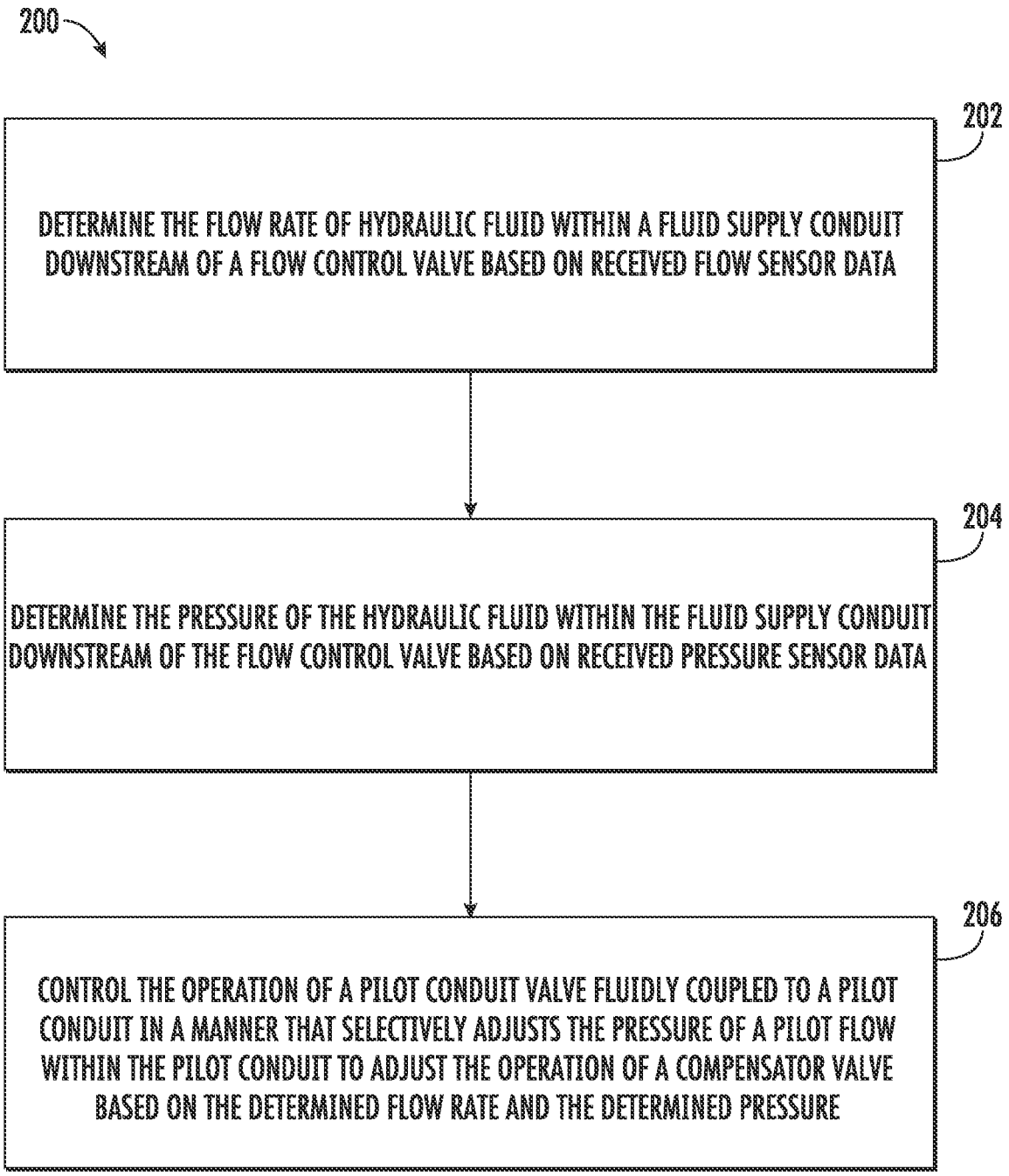
FIG. 4 illustrates a flow diagram of another embodiment of a method for controlling hydraulic fluid flow within a work vehicle in accordance with aspects of the present subject matter.

Referring now to FIG. 4, a flow diagram of one embodiment of a method 200 for controlling hydraulic fluid flow within a work vehicle is illustrated in accordance with aspects of the present subject matter. In general, the method 200 will be described herein with reference to the work vehicle 10 and the system 100 described above with reference to FIGS. 1-3. However, it should be appreciated by those of ordinary skill in the art that the disclosed method 200 may generally be implemented with any work vehicle having any suitable vehicle configuration and/or within any system having any suitable system configuration. In addition, although FIG. 4 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 4, at (202), the method 200 may include determining, with a computing system, the flow rate of hydraulic fluid within a fluid supply conduit downstream of a flow control valve based on received flow sensor data. More specifically, during operation of the work vehicle 10, the computing system 182 may receive data associated with the flow rate of the hydraulic fluid within the first fluid supply conduit 104 downstream of the first flow control valve 114 from the first flow sensor 170 (e.g., via the communicative link 184). In this respect, the computing system 182 may be configured to process or analyze the data received from the first flow sensor 170 to determine or estimate the flow rate of the hydraulic fluid within the first fluid supply conduit 104 downstream of the first flow control valve 114. For instance, the computing system 182 may include a look-up table(s), suitable mathematical formula, and/or an algorithm(s) stored within its memory device(s) 188 that correlates the received sensor data to the flow rate.

Moreover, at (202), the computing system 182 may be configured to determine the flow rate of the hydraulic fluid within the second fluid supply conduit 106 downstream of the second flow control valve 116. More specifically, during operation of the work vehicle 10, the computing system 182 may receive data associated with the flow rate of the hydraulic fluid within the second fluid supply conduit 106 downstream of the second flow control valve 116 from the second flow sensor 172 (e.g., via the communicative link 184). In this respect, the computing system 182 may be configured to process or analyze the data received from the second flow sensor 172 to determine or estimate the flow rate of the hydraulic fluid within the second fluid supply conduit 106 downstream of the second flow control valve 116. For instance, the computing system 182 may include a look-up table(s), suitable mathematical formula, and/or an algorithm(s) stored within its memory device(s) 188 that correlates the received sensor data to the flow rate.

Furthermore, at (202), the computing system 182 may be configured to determine the flow rate of the hydraulic fluid being discharged by the pump 102. More specifically, during operation of the work vehicle 10, the computing system 182 may receive data associated with the flow rate of the hydraulic fluid being discharged by the pump 102 from the third flow sensor 174 (e.g., via the communicative link 184). In this respect, the computing system 182 may be configured to process or analyze the data received from the third flow sensor 174 to determine or estimate the flow rate of the hydraulic fluid being discharged by the pump 102. For instance, the computing system 182 may include a look-up table(s), suitable mathematical formula, and/or an algorithm(s) stored within its memory device(s) 188 that correlates the received sensor data to the flow rate. Alternatively, as described above, the computing system 182 may determine or estimate the flow rate of hydraulic fluid within at the various locations within the system 100 based on the received flow rate data (which may, in some embodiments, be pump speed, swash plate angle, or other indirect measures of flow rate) and the pressure of the hydraulic fluid at such location.

Additionally, at (204), the method 200 may include determining, with a computing system, the pressure of hydraulic fluid within a fluid supply conduit downstream of the flow control valve based on received flow sensor data. More specifically, during operation of the work vehicle 10, the computing system 182 may receive data associated with the pressure of the hydraulic fluid within the first fluid supply conduit 104 downstream of the first flow control valve 114 from the first pressure sensor 176 (e.g., via the communicative link 184). In this respect, the computing system 182 may be configured to process or analyze the data received from the first pressure sensor 176 to determine or estimate the pressure of the hydraulic fluid within the first fluid supply conduit 104 downstream of the first flow control valve 114. For instance, the computing system 182 may include a look-up table(s), suitable mathematical formula, and/or an algorithm(s) stored within its memory device(s) 188 that correlates the received sensor data to the pressure.

Moreover, at (204), the computing system 182 may be configured to determine the pressure of the hydraulic fluid within the second fluid supply conduit 106 downstream of the second flow control valve 116. More specifically, during operation of the work vehicle 10, the computing system 182 may receive data associated with the pressure of the hydraulic fluid within the second fluid supply conduit 106 downstream of the second flow control valve 116 from the second pressure sensor 178 (e.g., via the communicative link 184). In this respect, the computing system 182 may be configured to process or analyze the data received from the second pressure sensor 178 to determine or estimate the pressure of the hydraulic fluid within the second fluid supply conduit 106 downstream of the second flow control valve 116. For instance, the computing system 182 may include a look-up table(s), suitable mathematical formula, and/or an algorithm(s) stored within its memory device(s) 188 that correlates the received sensor data to the pressure.

Furthermore, at (204), the computing system 182 may be configured to determine the pressure of the hydraulic fluid being discharged by the pump 102. More specifically, during operation of the work vehicle 10, the computing system 182 may receive data associated with the pressure of the hydraulic fluid being discharged by the pump 102 from the third pressure sensor 180 (e.g., via the communicative link 184). In this respect, the computing system 182 may be configured to process or analyze the data received from the third pressure sensor 180 to determine or estimate the pressure of the hydraulic fluid being discharged by the pump 102. For instance, the computing system 182 may include a look-up table(s), suitable mathematical formula, and/or an algorithm(s) stored within its memory device(s) 188 that correlates the received sensor data to the pressure.

In addition, as shown in FIG. 3, at (206), the method 200 may include controlling, with the computing system, the operation of a pilot conduit valve fluidly coupled to a pilot conduit in a manner that selectively adjusts the pressure of a pilot flow within the pilot conduit to adjust the operation of a compensator valve based on the determined flow rate and the determined pressure. More specifically, the computing system 182 may be configured to control the operation of the first pilot conduit valve 132 based on the determined flow rate and/or pressure of the hydraulic fluid within the first fluid supply conduit 104 downstream of the first flow control valve 114 and/or the determined flow rate and pressure of the hydraulic fluid being discharged by the pump 102. Similarly, the computing system 182 may be configured to control the operation of the second pilot conduit valve 134 based on the determined flow rate and/or pressure of the hydraulic fluid within the second fluid supply conduit 106 downstream of the second flow control valve 116 and/or the determined flow rate and pressure of the hydraulic fluid being discharged by the pump 102. For example, the computing system 182 may transmit control signals to the pilot conduit valves 132, 134 via the communicative link 184. Such control signals may instruct the pilot conduit valves 132, 134 to operate in a manner that adjusts the pressures of the pilot flows within the pilot conduits 124, 128, respectively. Adjusting the pressures of these pilot flows may, in turn, adjust the pressure drops across the first and second flow control valves 114, 116, respectively.

In several embodiments, at (206), the computing system 182 may be configured to control the operation of the pilot conduit valves 132, 134 to selectively reduce the pressure of the pilot flows received by the first and compensator valves 118, 120 from the pilot conduits 124, 128. More specifically, reducing the pressures of the pilot flows within the pilot conduits 124, 128 received by the first and compensator valves 118, 120 may reduce the pressure drop of the hydraulic fluid across the corresponding flow control valves 114, 116 below the pressure drop that would be set by the biasing elements 144 of the valves 118, 120 and the unadjusted pilot flows. For example, in certain instances, such as when the load on the vehicle's hydraulic system is low, the pilot conduit valves 132, 134 may be controlled such that the pressure drop across the corresponding flow control valves 114, 116 is reduced, thereby decreasing the energy consumption of the vehicle 10 (e.g., by reducing the load on the pump 102) and improving its fuel economy. Conversely, in other instances, such as when the load on the vehicle's hydraulic system is high, the actuators 146 may be deactivated and the pilot conduit valves 132, 134 may be controlled hydraulically (e.g., based on the pilot flows within pilot conduits 136, 138, 140, 142) to permit the system 100 to provide hydraulic fluid to the hydraulic loads (e.g., the lift and/or tilt cylinders 36, 28) at the desired pressure and flow rate.

Figure 5:
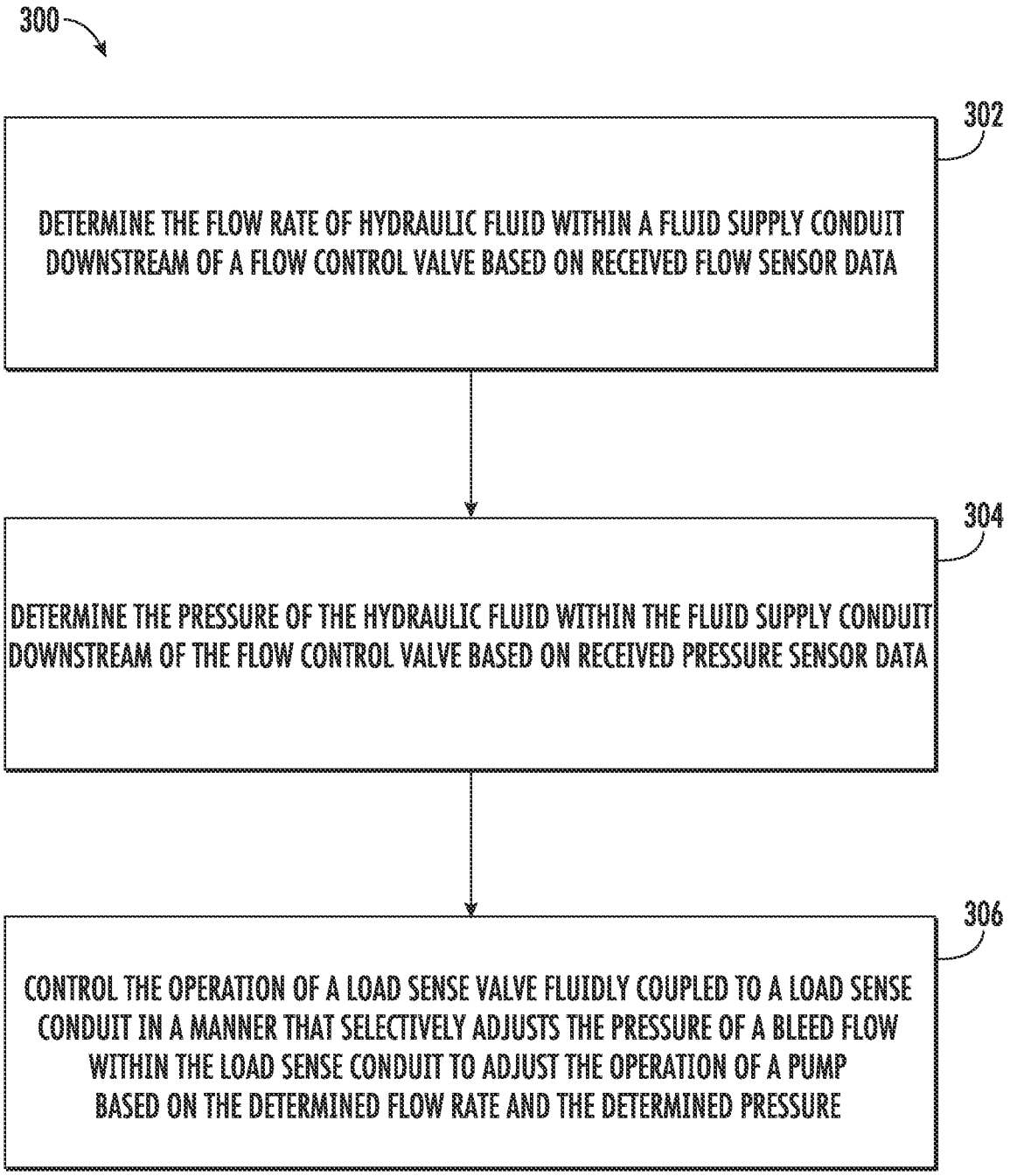
FIG. 5 illustrates a flow diagram of another embodiment of a method for controlling hydraulic fluid flow within a work vehicle in accordance with aspects of the present subject matter.

Referring now to FIG. 5, a flow diagram of another embodiment of a method 300 for controlling hydraulic fluid flow within a work vehicle is illustrated in accordance with aspects of the present subject matter. In general, the method 300 will be described herein with reference to the work vehicle 10 and the system 100 described above with reference to FIGS. 1-3. However, it should be appreciated by those of ordinary skill in the art that the disclosed method 300 may generally be implemented with any work vehicle having any suitable vehicle configuration and/or within any system having any suitable system configuration. In addition, although FIG. 5 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 5, at (302), the method 300 may include determining, with a computing system, the flow rate of hydraulic fluid within a fluid supply conduit downstream of a flow control valve based on received flow sensor data. For example, as described above, during operation of the work vehicle 10, the computing system 182 may be configured determine the flow rate(s) of hydraulic fluid within the first and/or second fluid supply conduits 104, 106 downstream of the first and/or second flow control valves 114, 116 based on data received from the first and/or second flow sensors 170, 172, respectively. Furthermore, at (302), the computing system 182 may be configured determine the flow rate of hydraulic fluid being discharged by the pump 102 based on data received from the third flow sensor 174. Alternatively, as described above, the computing system 182 may determine or estimate the flow rate of hydraulic fluid within at the various locations within the system 100 based on the received flow rate data (which may, in some embodiments, be pump speed, swash plate angle, or other indirect measures of flow rate) and the pressure of the hydraulic fluid at such location.

Additionally, at (304), the method 300 may include determining, with a computing system, the pressure of hydraulic fluid within a fluid supply conduit downstream of a flow control valve based on received flow sensor data. For example, as described above, during operation of the work vehicle 10, the computing system 182 may be configured determine the pressure(s) of hydraulic fluid within the first and/or second fluid supply conduits 104, 106 downstream of the first and/or second flow control valves 114, 116 based on data received from the first and/or second pressure sensors 176, 178, respectively. Moreover, at (304), the computing system 182 may be configured determine the pressure of hydraulic fluid being discharged by the pump 102 based on data received from the third pressure sensor 180.

In addition, as shown in FIG. 5, at (306), the method 300 may include controlling, with the computing system, the operation of a load sense valve fluidly coupled to a load sense conduit in a manner that selectively adjusts the pressure of a bleed flow within the load sense conduit to adjust the operation of a pump based on the determined flow rate and the determined pressure. More specifically, the computing system 182 may be configured to control the operation of the load sense valve 160 based on the determined flow rate and/or pressure of the hydraulic fluid within the first fluid supply conduit 104 downstream of the first flow control valve 114, the determined flow rate and/or pressure of the hydraulic fluid within the second fluid supply conduit 106 downstream of the second flow control valve 116, and/or the flow rate and/or pressure of the hydraulic fluid being discharged by the pump 102. For example, the computing system 182 may transmit control signals to the load sense valve 160 via the communicative link 184. Such control signals may instruct the load sense valve 160 to operate in a manner that adjusts the pressures of the bleed flow within the load sense conduit 148. Adjusting the pressures of the bleed flow within the load sense conduit 148 may, in turn, adjust the pressure of the hydraulic fluid discharged by the pump 102.

In several embodiments, at (306), the computing system 182 may be configured to control the operation of the load sense valve 160 to selectively reduce the pressure of the bleed flow received by the pump compensator 156. More specifically, reducing the bleed flow within the load sense conduit 148 received by the pump compensator 156 may reduce the pressure of the hydraulic fluid discharged by the pump 102 below the pressure that would be set by the biasing element of the pump compensator 156 and the unadjusted bleed flow. For example, in certain instances, such as when the load on the vehicle's hydraulic system is low, the load sense valve 160 may be controlled such that the pressure of the hydraulic fluid discharged by the pump 102 is reduced, thereby decreasing the energy consumption of the vehicle 10 (e.g., by reducing the load on the pump 102) and improving its fuel economy. Conversely, in other instances, such as when the load on the vehicle's hydraulic system is high, the actuator 168 may be deactivated and the load sense valve 160 may controlled hydraulically (e.g., based on the pilot flows within pilot conduits 162, 164) to permit the system 100 to provide hydraulic fluid to the hydraulic loads (e.g., the lift and/or tilt cylinders 36, 28) at the desired pressure and flow rate.

Figure 6:
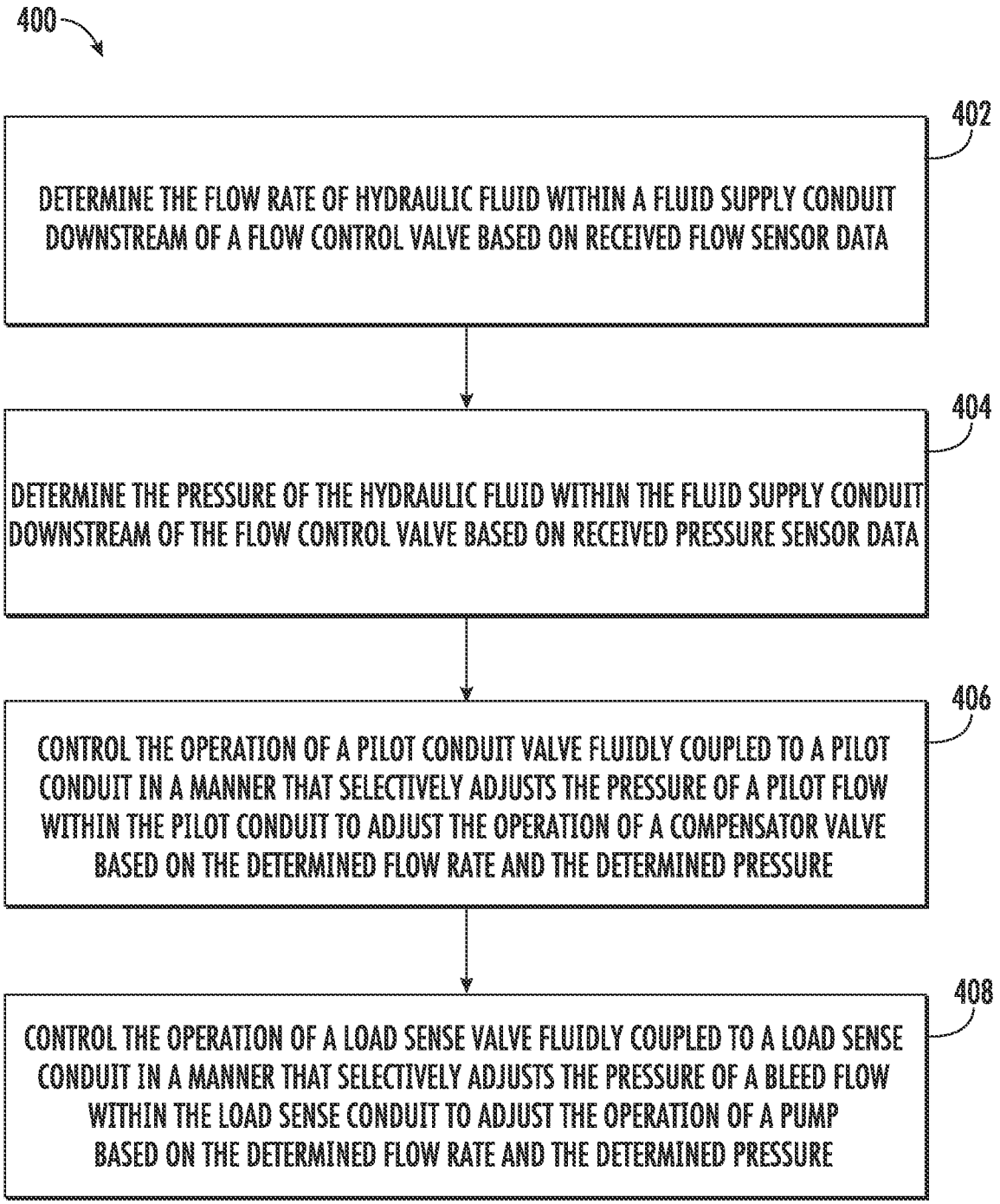
FIG. 6 illustrates a flow diagram of a further embodiment of a method for controlling hydraulic fluid flow within a work vehicle in accordance with aspects of the present subject matter.

Referring now to FIG. 6, a flow diagram of a further embodiment of a method 400 for controlling hydraulic fluid flow within a work vehicle is illustrated in accordance with aspects of the present subject matter. In general, the method 400 will be described herein with reference to the work vehicle 10 and the system 100 described above with reference to FIGS. 1-3. However, it should be appreciated by those of ordinary skill in the art that the disclosed method 400 may generally be implemented with any work vehicle having any suitable vehicle configuration and/or within any system having any suitable system configuration. In addition, although FIG. 6 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown in FIG. 6, at (402), the method 400 may include determining, with a computing system, the flow rate of hydraulic fluid within a fluid supply conduit downstream of a flow control valve based on received flow sensor data. For example, as described above, during operation of the work vehicle 10, the computing system 182 may be configured determine the flow rate(s) of hydraulic fluid within the first and/or second fluid supply conduits 104, 106 downstream of the first and/or second flow control valves 114, 116 based on data received from the first and/or second flow sensors 170, 172, respectively. Furthermore, at (402), the computing system 182 may be configured determine the flow rate of hydraulic fluid being discharged by the pump 102 based on data received from the third flow sensor 174. Alternatively, as described above, the computing system 182 may determine or estimate the flow rate of hydraulic fluid within at the various locations within the system 100 based on the received flow rate data (which may, in some embodiments, be pump speed, swash plate angle, or other indirect measures of flow rate) and the pressure of the hydraulic fluid at such location.

Additionally, at (404), the method 400 may include determining, with a computing system, the pressure of hydraulic fluid within a fluid supply conduit downstream of a flow control valve based on received flow sensor data. For example, as described above, during operation of the work vehicle 10, the computing system 182 may be configured determine the pressure(s) of hydraulic fluid within the first and/or second fluid supply conduits 104, 106 downstream of the first and/or second flow control valves 114, 116 based on data received from the first and/or second pressure sensors 176, 178, respectively. Moreover, at (402), the computing system 182 may be configured determine the pressure of hydraulic fluid being discharged by the pump 102 based on data received from the third pressure sensor 180.

In addition, as shown in FIG. 6, at (406), the method 400 may include controlling, with the computing system, the operation of a pilot conduit valve fluidly coupled to a pilot conduit in a manner that selectively adjusts the pressure of a pilot flow within the pilot conduit to adjust the operation of a compensator valve based on the determined flow rate and the determined pressure. For example, as described above, the computing system 182 may be configured to control the operation of the first and/or second pilot conduit valve 132, 134 to selectively adjust the pressure of the pilot flows within the pilot conduit 124, 128 to adjust the operation of the first and/or second compensator valves 118, 120 based on the determined flow rate(s) and the determined pressure(s).

Furthermore, as shown in FIG. 6, at (408), the method 400 may include controlling, with the computing system, the operation of a load sense valve fluidly coupled to a load sense conduit in a manner that selectively adjusts the pressure of a bleed flow within the load sense conduit to adjust the operation of a pump based on the determined flow rate and the determined pressure. For example, as described above, the computing system 182 may be configured to control the operation of the load sense valve 160 to selectively adjust the pressure of the bleed flow within the load sense conduit 148 to adjust the operation of the pump 102 based on the determined flow rate(s) and the determined pressure(s).

Controlling the pressure drops across first and second flow control valves 114, 116 via the first and second pilot conduit valves 132, 134 in conjunction within the controlling the pump discharge pressure via the load sense valve 130 may further improve the efficiency of the vehicle 10. For example, controlling the first and second pilot conduit valves 132, 134 and the load sense valve 130 together may allow for a smaller pressure differential between the pump 102 and the lift and tilt cylinders 36, 38.

It is to be understood that the steps of the methods 200, 300, 400 are performed by the computing system 182 upon loading and executing software code or instructions which are tangibly stored on a tangible computer readable medium, such as on a magnetic medium, e.g., a computer hard drive, an optical medium, e.g., an optical disc, solid-state memory, e.g., flash memory, or other storage media known in the art. Thus, any of the functionality performed by the computing system 182 described herein, such as the methods 200, 300, 400, is implemented in software code or instructions which are tangibly stored on a tangible computer readable medium. The computing system 182 loads the software code or instructions via a direct interface with the computer readable medium or via a wired and/or wireless network. Upon loading and executing such software code or instructions by the computing system 182, the computing system 182 may perform any of the functionality of the computing system 182 described herein, including any steps of the methods 200, 300, 400 described herein.

The term "software code" or "code" used herein refers to any instructions or set of instructions that influence the operation of a computer or controller. They may exist in a computer-executable form, such as machine code, which is the set of instructions and data directly executed by a computer's central processing unit or by a controller, a human-understandable form, such as source code, which may be compiled in order to be executed by a computer's central processing unit or by a controller, or an intermediate form, such as object code, which is produced by a compiler. As used herein, the term "software code" or "code" also includes any human-understandable computer instructions or set of instructions, e.g., a script, that may be executed on the fly with the aid of an interpreter executed by a computer's central processing unit or by a controller.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

The invention claimed is:

1. A system for controlling hydraulic fluid flow within a work vehicle, the system comprising:

a hydraulic load;

a pump configured to supply hydraulic fluid to the hydraulic load via a fluid supply conduit;

a flow control valve fluidly coupled to the fluid supply conduit upstream of the hydraulic load;

a compensator valve fluidly coupled to the fluid supply conduit upstream of the hydraulic load;

a pilot conduit fluidly coupled to the fluid supply conduit downstream of the flow control valve and the compensator valve, the pilot conduit configured to receive a pilot flow of the hydraulic fluid from the fluid supply conduit such that an operation of the compensator valve is controlled based on a pressure of the pilot flow within the pilot conduit;

a pilot conduit valve fluidly coupled to the pilot conduit, the pilot conduit valve configured to adjust the pressure of the pilot flow within the pilot conduit;

a pressure sensor configured to capture data indicative of a pressure of the hydraulic fluid within the fluid supply conduit downstream of the flow control valve;

a flow sensor configured to capture data indicative of a flow rate of the hydraulic fluid within the fluid supply conduit downstream of the flow control valve; and a computing system communicatively coupled to the pressure sensor and the flow sensor, the computing system configured to:

determine the pressure of the hydraulic fluid within the fluid supply conduit downstream of the flow control valve based on the data captured by the pressure sensor;

determine the flow of the hydraulic fluid within the fluid supply conduit downstream of the flow control valve based on the data captured by the pressure sensor; and control an operation of the pilot conduit valve to selectively adjust the pressure of the pilot flow within the pilot conduit based on the determined pressure and the determined flow rate.

2. The system of claim 1, wherein the compensator valve is configured to adjust a pressure drop of the hydraulic fluid across the flow control valve based on the pressure of the pilot flow received from the pilot conduit.

3. The system of claim 2, wherein, when controlling the operation of the pilot conduit valve, the computing system is configured to control the operation of the pilot conduit valve in a manner that selectively reduces the pressure of the pilot flow received by the compensator valve such that the pressure drop across the compensator valve is selectively reduced.

4. The system of claim 1, wherein the pilot conduit corresponds to a first pilot conduit and the pilot flow corresponds to a first pilot flow, the system further comprising:

a second pilot conduit fluidly coupled to the fluid supply conduit upstream of the flow control valve, the pilot second conduit configured to receive a second pilot flow of the hydraulic fluid from the fluid supply conduit such that the operation of the compensator valve is controlled based on a pressure of the second pilot flow and the pressure of the first pilot flow.

5. The system of claim 1, wherein the pressure sensor corresponds to a first pressure sensor and the pressure of the hydraulic fluid within the fluid supply conduit downstream of the flow control valve corresponds to a first pressure, the system further comprising:

a second pressure sensor configured to capture data indicative of a second pressure of the hydraulic fluid being discharged by the pump, the computing system further configured to:

determine the second pressure based on the data captured by the second pressure sensor; and control the operation of the pilot conduit valve to adjust the pressure of the pilot flow within the pilot conduit based on the determined first and second pressures and the determined flow rate.

6. The system of claim 5, wherein the flow sensor corresponds to a first flow sensor and the flow rate of the hydraulic fluid within the fluid supply conduit downstream of the flow control valve corresponds to a first flow rate, the system further comprising:

a second flow sensor configured to capture data indicative of a second flow rate of the hydraulic fluid being discharged by the pump, the computing system further configured to:

determine the second flow rate based on the data captured by the second flow sensor; and control the operation of the pilot conduit valve to adjust the pressure of the pilot flow within the pilot conduit based on the determined first and second pressures and the determined first and second flow rates.

7. The system of claim 1, wherein the compensator valve is positioned upstream of the flow control valve.

8. The system of claim 1, wherein the pilot conduit valve comprises a pilot-operated valve.

9. The system of claim 8, wherein the pilot-operated valve comprises an electronically controlled solenoid.

10. The system of claim 1, wherein the pilot flow is retained within the pilot conduit when the pressure of the pilot flow is adjusted by the pilot valve.

11. A method for controlling hydraulic fluid flow within a work vehicle, the work vehicle including a pump configured to supply hydraulic fluid to a hydraulic load via a fluid supply conduit, a flow control valve fluidly coupled to the fluid supply conduit upstream of the hydraulic load, a compensator valve fluidly coupled to the fluid supply conduit upstream of the hydraulic load, and a pilot conduit fluidly coupled to the fluid supply conduit and the compensator valve, the pilot conduit configured to receive a pilot flow of the hydraulic fluid from the fluid supply conduit such that an operation of the compensator valve is controlled based on a pressure of the pilot flow within the pilot conduit, the method comprising:

determining, with a computing system, a flow rate of the hydraulic fluid within the fluid supply conduit downstream of the flow control valve based on received flow sensor data;

determining, with the computing system, a pressure of the hydraulic fluid within the fluid supply conduit downstream of the flow control valve based on received pressure sensor data; and controlling, with the computing system, an operation of a pilot conduit valve fluidly coupled to the pilot conduit in a manner that selectively adjusts the pressure of the pilot flow within the pilot conduit to adjust the operation of the compensator valve based on the determined flow rate and the determined pressure.

12. The method of claim 11, wherein the compensator valve is configured to adjust a pressure drop across the flow control valve based on the pressure of the pilot flow received from the pilot conduit.

13. The method of claim 11, wherein controlling the operation of the pilot conduit valve comprises controlling, with the computing system, the operation of the pilot conduit valve in a manner that selectively reduces the pressure of the pilot flow received by the compensator valve such that a pressure drop of the hydraulic fluid across the compensator valve is selectively reduced.

14. The method of claim 11, wherein the pressure of the hydraulic fluid within the fluid supply conduit downstream of the flow control valve corresponds to a first pressure, the method further comprising:

determining, with the computing system, a second pressure of the hydraulic fluid being discharged by the pump, and wherein controlling the operation of the pilot conduit valve comprises controlling, with the computing system, the operation of the pilot conduit valve to adjust the pressure of the pilot flow within the pilot conduit based on the determined first and second pressures and the determined flow rate.

15. The method of claim 14, wherein the flow rate of the hydraulic fluid within the fluid supply conduit downstream of the flow control valve corresponds to a first flow rate, the method further comprising:

determining, with the computing system, a second flow rate of the hydraulic fluid being discharged by the pump, and wherein controlling the operation of the pilot conduit valve comprises controlling, with the computing system, the operation of the pilot conduit valve to adjust the pressure of the pilot flow within the pilot conduit based on the determined first and second pressures and the determined first and second flow rates.

16. The method of claim 11, wherein the compensator valve is positioned upstream of the flow control valve.

17. The method of claim 11, wherein the pilot conduit valve comprises a pilot-operated valve.

18. The method of claim IS, wherein the pilot-operated valve comprises an electronically controlled solenoid.

19. The method of claim 11, wherein the work vehicle further includes a load sense conduit fluidly coupled to the fluid supply conduit downstream of a flow control valve, the load sense conduit configured to receive a bleed flow of the hydraulic fluid from the fluid supply conduit such that an operation of the pump is controlled based on a pressure of the bleed flow within the load sense conduit, the method further comprising:

controlling, with the computing system, an operation of a load sense valve fluidly, coupled to the load sense conduit in a manner that selectively adjusts the pressure of the bleed flow within the load sense conduit to adjust the operation of the pump based on the determined flow rate and the determined pressure.

* * * * *